US005257469A

United States Patent [19]

Beasley

[11] Patent Number: 5,257,469

[45] Date of Patent: Nov. 2, 1993

[54] SHOE PROTECTOR AND METHOD OF USING THE SAME

[76] Inventor: Zachary P. Beasley, 17310 Mahoney Pkwy., Hazelcrest, Ill. 60429

[21] Appl. No.: 740,328

[22] Filed: Aug. 5, 1991

[51] Int. Cl.[5] ..... A43B 23/00

[52] U.S. Cl. ..... 36/72 R; 36/72 B; 36/7.1 R

[58] Field of Search ..... 36/72 R, 72 B, 7.1 R, 36/50

[56] References Cited

U.S. PATENT DOCUMENTS

| | | | |
|---|---|---|---|
| 1,417,934 | 5/1922 | Miller | 36/72 B |
| 1,708,964 | 4/1929 | Boomer | 36/72 B |
| 1,828,246 | 10/1931 | Destro | 36/72 B |
| 3,025,617 | 3/1962 | Rizzonelli | 36/72 B |
| 4,662,082 | 5/1987 | Shabazz | 36/72 B |
| 4,756,097 | 7/1988 | Sanders | 36/72 R |
| 4,794,705 | 1/1989 | Sanders | 36/72 R |
| 5,044,097 | 9/1991 | Young | 36/72 R |

FOREIGN PATENT DOCUMENTS

| | | | |
|---|---|---|---|
| 2642278 | 8/1990 | France | 36/72 B |
| 256864 | 7/1926 | United Kingdom | 36/72 B |
| 2223157 | 4/1990 | United Kingdom | 36/72 B |
| 2225702 | 6/1990 | United Kingdom | 36/72 B |

OTHER PUBLICATIONS

A.M.A. Journal, vol. 168 No. 7 Oct. 1958.

*Primary Examiner*—Steven N. Meyers
*Assistant Examiner*—M. D. Patterson

[57] ABSTRACT

A shoe protector having a body with a back portion having a length for protectively covering a rear portion of a shoe and side portions connectable to each other at a location and adapted to overlie an instep region of the shoe and including a way for selectively adjusting the length of the back portion of the body. Further, a back portion which has an upper peripheral edge and part and lower peripheral edge and part to cover the rear portion of a shoe and side portions which extend from the back portion for securement to each other over the instep region of the shoe and a dart in the back portion which extends to the lower peripheral edge to taper the lower part relative to the upper part and to position the lower part to conform to the contour of the rear portion of the shoe. Further, a back portion for covering a rear portion of a shoe and elongate side portions extending from the back portion to engage each other over an instep region of the shoe are provided with a way for concurrently securing the side portions together at multiple locations along their length. Finally, methods for utilizing the same are provided.

12 Claims, 2 Drawing Sheets

Fig. 1
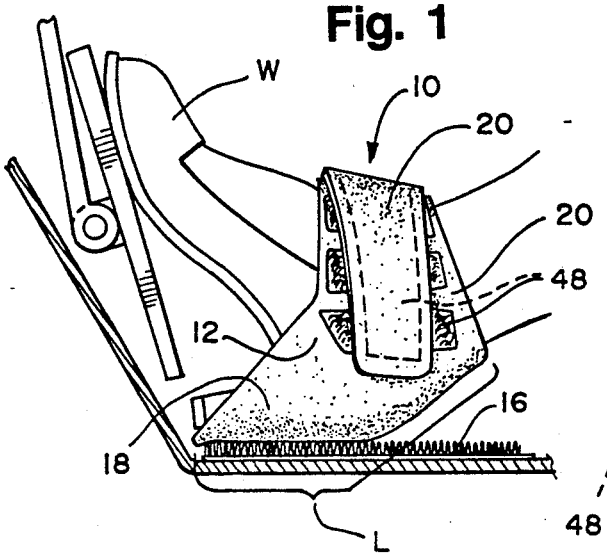
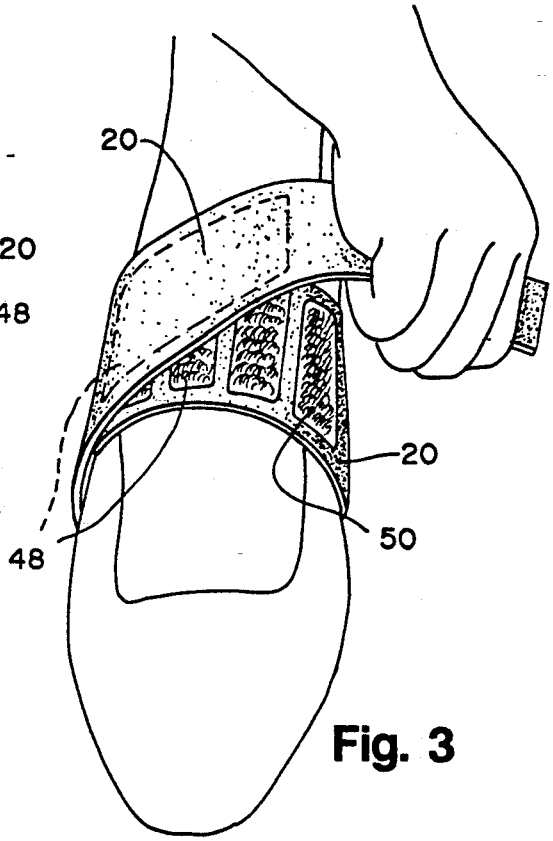
Fig. 3
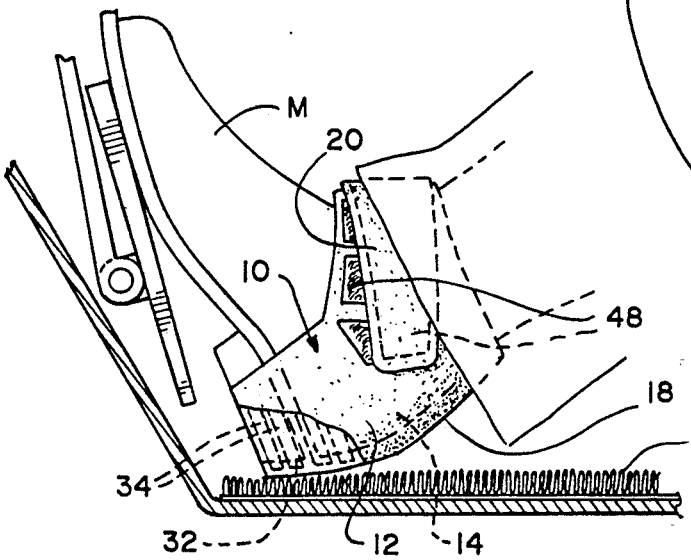
Fig. 2
Fig. 4
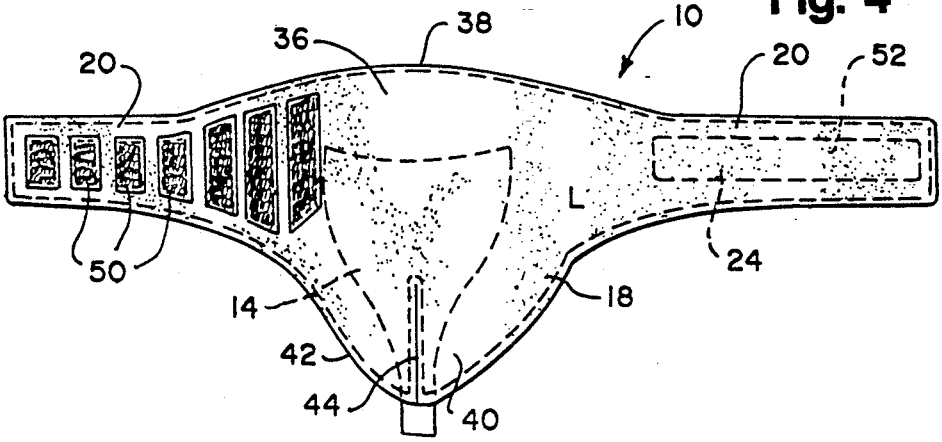

SHOE PROTECTOR AND METHOD OF USING THE SAME

BACKGROUND OF THE INVENTION

1. Field of the Invention

The present invention relates to a shoe protector and a method to use the same, and more particularly a shoe protector having a means to adjust the length, a dart in the back portion and a means to concurrently secure its sided portions in multiple locations and methods to utilize the same.

2. Description of the Prior Art

Various shoe protectors are known for protecting the rear portion of a shoe from abrasion or discoloration at a time the wearer of the shoe is operating a motor vehicle. However, none of them provide means for selectively adjusting the length of the back portion of such a protector to accommodate various heights of heels on shoes. This feature provides a wearer to utilize a shoe protector for various high or low heeled shoes without having to need custom shoe protectors having different length back portions to accommodate shoes having different height heels.

In U.S. Pat. No. 3,066,427 issued Dec. 4, 1962, to Matthews, tuck lines are used to provide compound curvature to an upper part of a rear portion of a shoe. This structure does not have a dart which extends to a lower peripheral edge of the back portion which tapers the lower part of the back portion relative to the upper portion of the back portion and position the lower part to conform to the contour of the rear portion of the shoe.

In U.S. Pat. No. 1,417,934 issued May 30, 1922, to Miller, a snap fastener is used on one strap member and multiple mating snap members are provided on the other strap member. This structure only permits engaging the strap members of the shoe protector in one predetermined discrete location at a time which provides limited adaptability to varying sized shoes.

SUMMARY OF THE INVENTION

It is therefore an object of this invention to provide a shoe protector having a body with a back portion having a length for protectively covering a rear portion of a shoe and side portions connectable to each other at a location and adapted to overlie an instep region of the shoe. This shoe protector also has a means for adjusting the length of the back portion of the body.

Another object of this invention is to provide a shoe protector having a body with a back portion having an upper part with an upper peripheral edge and a lower peripheral edge to cover a rear portion of a shoe, and side portions which extend from the back portion for securement to each other over the instep region of the shoe. This shoe protector also has a dart in the back portion which extends to the lower peripheral edge to taper the lower part relative to the upper part and to position the lower part to conform to the contour of the rear portion of the shoe.

Another object of this invention is to provide a shoe protector having a body with a back portion for covering a rear portion of a shoe and elongate side portions extending from the back portion to engage each other over an instep region of the shoe. This shoe protector also has a means for concurrently securing the side portions together at multiple locations along their length.

Another object of this invention is to provide a method for protecting a rear portion of a shoe with a body having a back portion with a length adapted to cover the rear portion of a shoe, including the steps of making a determination of the length of the rear portion of a shoe to be protected and adjusting the length of the back portion of the body based on said determination.

Another object of this invention is to provide a method for protecting a rear portion of shoe having a back portion with an upper peripheral edge, lower peripheral edge for covering a rear portion of a shoe and a deformable dart in the back portion which extends to the lower peripheral edge, including the steps of positioning the back portion and the dart over the rear portion of the shoe and folding the back portion at the dart to contour the back portion to the rear portion of the shoe.

Another object of this invention is to provide a method for protecting a rear portion of a shoe with a body having a back portion for covering the rear portion of shoe and elongate side portions extending from the back portion to engage each other over the instep region of the shoe and means for concurrently securing the side portions together at multiple locations along their length, including the steps of positioning the back portion to cover the rear portion of the shoe to be protected and engaging the means for concurrently securing the side portions together at multiple locations along their length over the instep region of the shoe.

BRIEF DESCRIPTION OF THE DRAWINGS

The foregoing objects and advantageous features of the invention will be explained in greater detail and others will be made apparent from the detailed description of the embodiments of the present invention which is given with reference to the several figures of the drawing, in which:

FIG. 1 is a perspective view of the shoe protector as worn on a woman's high heeled shoe;

FIG. 2 is a perspective view of the shoe protector as worn on a man's shoe showing an embodiment of a length adjustment means in use;

FIG. 3 is a top view of the shoe protector as it is being secured over the instep region of a shoe;

FIG. 4 is a plan view of the outside of the shoe protector positioned to be placed over the back portion of a shoe;

FIG. 8 is an outside plan view of another embodiment of the shoe protector in which;

DETAILED DESCRIPTION

Figure 5:
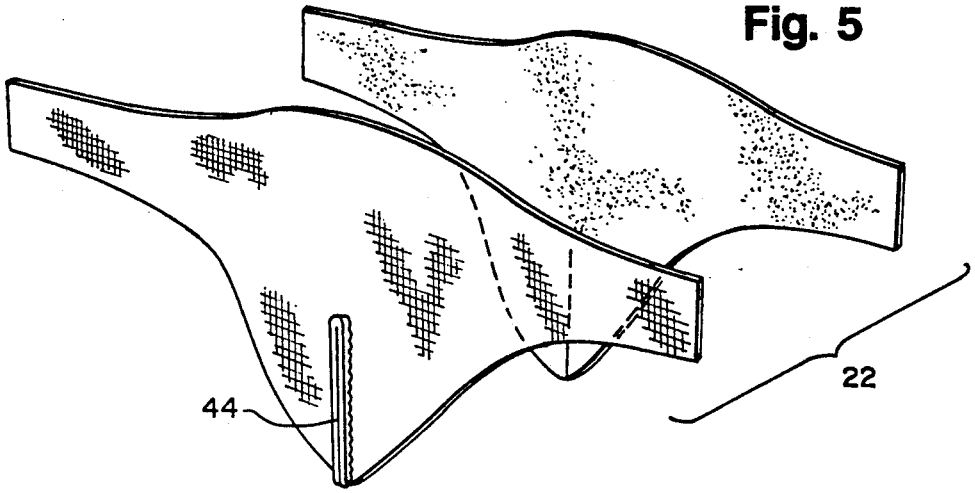
FIG. 5 is an exploded view of a multilayered the body of the shoe protector.

Referring now to the drawings, in FIG. 1 is shown shoe protector 10 as it is worn on a woman's (high heeled) shoe W and in FIG. 2 shoe protector 10 as it is worn on a man's (low heeled) shoe M. Shoe protector 10 is generally used to protect rear portion 14 of any shoe, having different height rear portions 14, as shown in FIGS. 2 and 4, from abrasive contact with carpeting or floor covering 16 which can occur while operating a motor vehicle.

Body 12 has back portion 18 which will have a sufficient length L to protectively cover rear portion 14 of a shoe. Body 12 further has side portions 20 which are connectable at a location and adapted to overlie an instep region of a shoe, as seen in FIGS. 1-3 and 9.

Body 12 is composed generally of a flexible material to provide conforming contact of body 12 over portions of the shoe and the foot of a wearer. Body 12 preferably made of a stretchable material such as plastics, vinyls, rubber other natural and synthetic blended materials. These stretchable materials are substantially resilient such as some of the above mentioned materials including most stretchable cotton/synthetic blends and the like. This characteristic gives body 12 grasping force onto the shoe when body 12 is pulled snugly around the shoe at the time you connect side portions 20. Because of the characteristic of resiliency, such shoe protector could be effectively reused on the same or on various sized shoes. Another type of material includes a stretchable but deformable type of material. These materials typically are synthetic such as a plastic wrap and the like which will stretch but not completely return to its original size. Such characteristic will provide the grasping force when body 12 is pulled snugly over the shoe and the side portions are connected, however, the material will not return to its original size and would not be conducive to reuse on various sized shoes or even on the same shoe and thereby relatively disposable.

Figure 6:
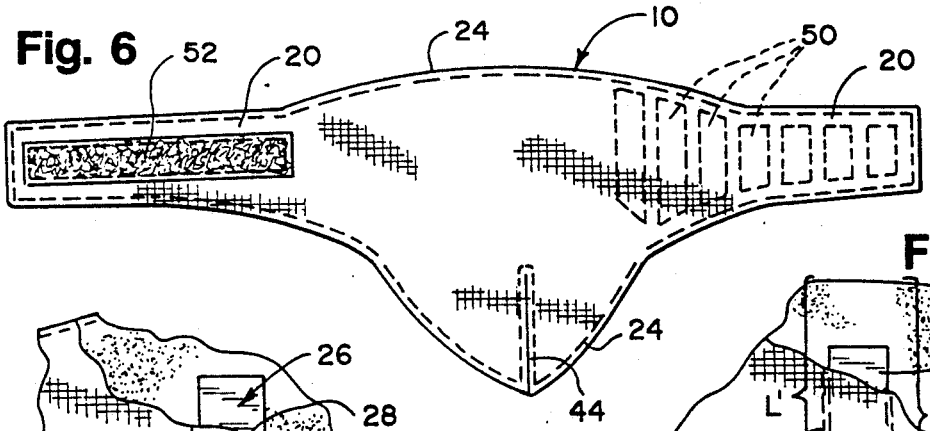
FIG. 6 is a plan view of the inside of the shoe protector.

Body 12 can be multilayered 22, as seen in FIG. 5, and sewn together as shown by stitching 24 in FIG. 6. Typically two layers are used in which the inside layer, which contacts the shoe, are nonabrasive, such as a combination of cotton and polyester which provides a soft and stretchable composition or other common soft compositions of material. The layer not in contact with the shoe is commonly made of a tougher composition which includes cotton and nylon and/or other materials that have been mentioned above which provide strength and stretchability.

Figure 7:
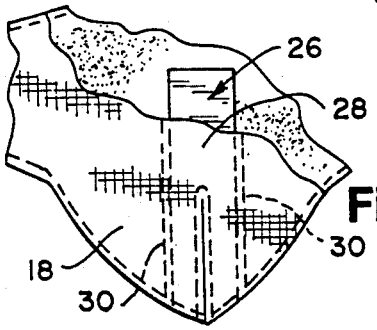
FIG. 7 is a partial broken away view of the body of the shoe protector showing a length adjusting means.
Figure 7A:
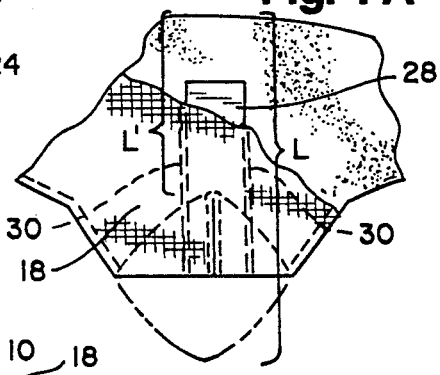
FIG. 7A is a partial broken away view of the body of the shoe protector showing the length adjusting means of FIG. 7 shortening the length of body.

Shoe protector 10 has adjusting means 26 for selectively adjusting the length L of the back portion 18 of body 12. This typically includes a portion of back portion 18 being foldable to a position to overlie upon back portion 18 such that back portion 18 of body 12 remains intact, as seen in FIGS. 2 and 7A. One of many embodiments of adjusting means 26 includes deformable body 28 which is secured to and along a portion of length L of back portion 18 of body 12 typically by sewing body 28 into back portion 18 with stitching 30, as seen in FIGS. 7 and 7A. Deformable body 28 typically made of any metallic strip which is bendable to any desired length, have sufficient rigidity to maintain such desired position and thereafter be returned to its original unbent length or to a new bent length and so on. Likewise, the same is accomplished with compositions of deformable plastics. As seen in FIG. 7, deformable body 28 is in an unbent or nondeformed extended position which will accommodate higher heeled women's shoes as displayed as W in FIG. 1. In FIG. 7A, deformable body 28 is bent or deformed, shortening back portion 18 from length L to L'.

Figure 8:
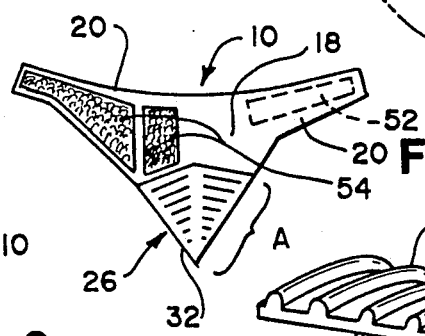
Figure 9:
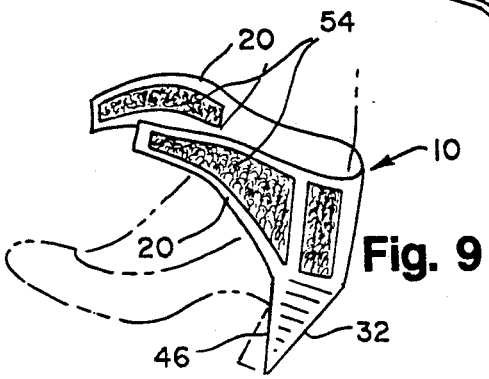
FIG. 9 is a perspective view of the embodiment of the shoe protector of FIG. 8 being secured over the instep region of a shoe.
Figure 10:
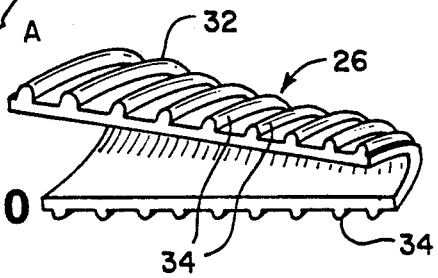
FIG. 10 is an enlarged perspective view of the embodiment of the length adjustment means shown as A in FIG. 8 and used in FIG. 2.

Another embodiment of adjusting means 26 includes flexible nonabrasive frictional surface 32 disposed in back portion 18 of body 12, as seen in FIGS. 1, 8-10. Surface 32 typically is composed of various rubber-like materials. Surface 32 is typically secured to at least a lower portion of back portion 18, as seen in FIGS. 8 and 9. Additionally, surface 32 has ribs 34, as seen in FIG. 10, which can further assist surface 32 to frictionally grip rear portion 14 of a shoe when folded behind rear portion 14 of shoe and contacting the same, as seen in FIG. 2. Thus, surface 32 which is secured to back portion 18 is folded behind the shoe and will be held there by the securement of the shoe protector over the instep region of the shoe and by contact friction between rear portion 14 of the shoe and frictional characteristic material used in surface 32, thereby giving the user the ability to adjust the length of back portion 18 to a desired length.

Shoe protector 10 has a back portion 18 having upper part 36 and peripheral edge 38 and lower part 40 and lower peripheral edge 42, as seen in FIG. 4. Dart 44 is disposed in lower part 40 of back portion 18 and extends to lower peripheral edge 42 and tapers lower part 40 relative to upper part 36, as seen in FIG. 4. This tapering creates a better fit of back portion to rear portion 14 of a women's high heeled shoe, as well as, providing less material to be folded under and between rear portion 14 of the shoe and back portion 18 of body 12 when accommodating a shorter heel, as seen in FIG. 2 and 7 A. Dart 44 also permits back portion 18 to conform to the contour of rear portion 14 of a shoe. Dart 44 is generally located in a central location of back portion 18 of body 12, as seen in FIG. 4, to align with a central area of rear portion 14 of the shoe to and thereby provide approximate symmetrical fit of back portion 18 around the rear portion 14 of the shoe. Also, dart 44 also creates a concave region 46, as seen in FIG. 9, in back portion 18 of body 12 to assist in accommodating a better fit to higher heeled shoes.

Shoe protector 10 has back portion 18 to cover rear portion 14 of the shoe and elongate side portions 20 which extend from back portion 18 to engage each other over the instep region of the shoe and has securing means 48 for concurrently securing side portions 20 together at multiple locations along side portions 20 lengths. Securing means 48 include spaced apart patches 50 of one of hooks and loops material, more conventionally known as a velcro type material, as seen in FIGS. 3, 4 and 6, and includes strip 52 of corresponding one of hooks and loops material disposed on the other of side portion 20 for releasably engaging side portions 20 together. The spaces in between patches 50 are often of a stretchable material permitting a more reliable securement of shoe protector 10 to the shoe. The wearer can pull on side portions 20 and more effectuate a tighter securement to the shoe. In addition, patches 50 run transverse to the length of side strip 20, as seen in FIG. 4, and generally increase in length this transverse direction to permit a wide latitude of possible alignments of side portions 20 to accommodate varying sized shoes and the multiple locations of connection provide additional reliable securement for varying sized shoes.

Another embodiment of securing means 48 can be seen as 54 in FIGS. 8 and 9. Patches 50 have the same capabilities as the embodiment described above but has less of them and reduces production costs.

Thus, in using shoe protector 10, the user makes a determination of the length of rear portion 14 of the shoe to be protected and adjusts the length of back portion 18 of body 12 based on such determination. This includes operating adjusting means 26 disposed to back portion 18 to adjust the length of back portion 18 of body 12 to cover rear portion 14 of the shoe to be protected. This typically includes folding a deformable strip and thereby adjusting the length of back portion 18. This also includes folding at least a part of back portion 18 which carries a flexible non-abrasive frictional surface 32 in between rear portion 14 of the shoe and a remainder of back portion 18 contacting surface 32 to rear portion 14 of the shoe thereby adjusting the length of back portion 18 to the desired length and maintaining that length as desired. This is shown in FIGS. 2, 7, 7A and 8–10.

A user is capable of positioning back portion 18 of body 12 over rear portion 14 of the shoe with at least a lowest portion of each opposing side edges 43 and 45 positioned on each side of the shoe to openly receive the rear portion of the shoe, as seen in FIGS. 4 and 6, such that and dart 44 which is located in lower part 40 of back portion 18 and into lower peripheral edge 42, as seen in FIG. 4, over rear portion 14 of the shoe and fold back portion 18 at dart 44 to contour back portion 18 to rear portion 14 of the shoe. This includes placing dart 44 which can be located in a central portion of back portion 18 over a central rear portion of the shoe, as seen in FIG. 4. Dart 44 creates a concave region 46 which will receive rear portion 14 of the shoe.

A user is capable of positioning back portion 18 to cover rear portion 14 of the shoe to be protected and engage the securing means which concurrently secures side portions 20 together at multiple locations along the length of side portions 20 over the instep region of the shoe. This includes mating strip 52 having one of hooks and loops with at least one of patches 50 having one of hooks and loops, to snugly secure back portion 18 over rear portion 14 of the shoe. Further, this also includes aligning elongate side portions 20 in desired alignment to obtain reliable securement of shoe protector 10 to a particular sized shoe prior to engaging strip 52 to at least one patch 50. This is made easier with patches 50 increasing in length transverse to side portion 20 length as patches approach back portion 18, allowing numerous alignments between side portions 20 to accommodate varying sized shoes.

While a detailed description of the preferred embodiment of the invention has been given, it should be appreciated that many variations can be made thereto without departing from the scope of the invention as set forth in the appended claims.

I claim:

1. A shoe protector, comprising:

a body made of stretchable material with a back portion for covering a rear portion of a shoe and elongate side portions extending from the back portion to engage each other over an instep region of the shoe; and means for concurrently securing the side portions together at multiple locations along their length which includes spaced apart patches of one of hooks and loops material being strips disposed upon and transverse to the side portion which overlies the instep region of the shoe and a strip of corresponding mating one of hooks and loops material disposed on the other of said side portions for releasably engaging the side portions together.

2. The shoe protector of claim 1 in which each of the strips increase in length as each strip approaches the back portion of the body.

3. The shoe protector of claim 1 in which the body is composed of a flexible material.

4. The shoe protector of claim 1 in which the body is composed of stretchable material.

5. The shoe protector of claim 4 in which the stretchable material is substantially resilient.

6. The shoe protector of claim 4 in which the stretchable material is deformable.

7. The shoe protector of claim 1 in which the body is multilayered.

8. A method for protecting a rear portion of a shoe with a body having a back portion with a length adapted to cover the rear portion of a shoe, comprising the steps of:

making a determination of the length of the rear portion of a shoe to be protected; and adjusting the length of the back portion which includes a deformable strip disposed along at least a portion of the back portion including the step of folding the strip to adjust the length of the back portion to cover the rear portion of the shoe to be protected.

9. A method for protecting a rear portion of a shoe with a body having a back portion with an upper and lower peripheral edges, and opposing side edges in which the back portion covers the rear portion of the shoe and in which a deformable dart in the back portion extends to the lower peripheral edge, comprising the steps of:

positioning the back portion of the body over the rear portion of the shoe with at least a lower portion of each opposing side edge positioned on each side of the shoe to opening receive the rear portion of the shoe such that the dart is positioned over the rear portion of the shoe; and folding the back portion at the dart to contour the back portion to the rear portion of the shoe.

10. The method of claim 9 in which the dart is disposed in a central portion of the back portion including the step of placing the dart over a central rear portion of the shoe.

11. The method of claim 9 in which the dart creates a concave region in the back portion to receive the rear portion of the shoe.

12. A method for protecting a rear portion of a shoe with a body having a back portion for covering the rear portion of the shoe and elongate side portions extending from the back portion to engage each other over the instep region of the shoe, comprising the steps of:

positioning the back portion to cover the rear portion of the shoe to be protected; and engaging a means for concurrently securing the side portions together at multiple locations along their length over the instep region of the shoe in which the means for concurrently securing includes spaced apart patches of one of hooks and loops material disposed along one of said elongate side portions transverse to the elongate side portion on which it is disposed and in which the length of each patch increases as each patch approaches the back portion and a strip of corresponding mating one of hooks and loops material disposed on the other of said elongate side portion including the step of aligning the elongate side portions in a desired alignment prior to engaging and mating of the strip and at least one patch together to snugly secure the back portion over the rear portion of the shoe.

* * * * *

UNITED STATES PATENT AND TRADEMARK OFFICE

CERTIFICATE OF CORRECTION

PATENT NO. : 5,257,469

DATED : November 2, 1993

INVENTOR(S) : Zachary P. Beasley

It is certified that error appears in the above-identified patent and that said Letters Patent is hereby corrected as shown below:

Col. 6, line 41, change "opening" to --openly--

Signed and Sealed this

Nineteenth Day of April, 1994

Bruce Lehman

*Attest:*

BRUCE LEHMAN

*Attesting Officer*

*Commissioner of Patents and Trademarks*